US005813336A

United States Patent [19]

Guaraldi et al.

[11] Patent Number: 5,813,336

[45] Date of Patent: Sep. 29, 1998

[54] PRINTING UNIT WITH AXIALLY REMOVABLE PRINTING SLEEVES

[75] Inventors: Glenn A. Guaraldi, Kingston; Roland T. Palmatier, Durham; Roger R. Belanger, Dover, all of N.H.

[73] Assignees: Heidelberger Druckmaschinen AG, Heidelberg, Germany; Heidelberg Harris, Inc., Dover, N.H.

[21] Appl. No.: 577,642

[22] Filed: Dec. 22, 1995

[51] Int. Cl.[6] ..... B41F 7/02

[52] U.S. Cl. ..... 101/218; 101/247

[58] Field of Search ..... 101/153, 216, 101/217, 218, 247, 375, 182, 184, 185, 376

[56] References Cited

U.S. PATENT DOCUMENTS

| | | | |
|---|---|---|---|
| 3,646,886 | 3/1972 | Woessner et al. | 101/378 |
| 4,301,728 | 11/1981 | Jaffe et al. | 101/247 |
| 4,408,868 | 10/1983 | Thonas et al. . | |
| 4,487,122 | 12/1984 | George et al. | 101/153 |
| 4,729,310 | 3/1988 | Love, III . | |
| 5,005,475 | 4/1991 | Knauer | 101/218 |
| 5,129,321 | 7/1992 | Fadner . | |
| 5,237,920 | 8/1993 | Guaraldi | 101/216 |
| 5,241,905 | 9/1993 | Guaraldi . | |
| 5,301,609 | 4/1994 | Guaraldi et al. | 101/247 |
| 5,351,616 | 10/1994 | Gelinas et al. . | |
| 5,385,093 | 1/1995 | Rogge et al. | 101/247 |
| 5,526,746 | 6/1996 | Capdeboscq | 101/415.1 |

FOREIGN PATENT DOCUMENTS

| | | |
|---|---|---|
| 0 512 549 A1 | 11/1992 | European Pat. Off. . |
| 3248178 C2 | 7/1984 | Germany . |
| 3911932 C2 | 10/1990 | Germany . |
| WO 84/02494 | 7/1984 | WIPO . |

*Primary Examiner*—Ren Yan
*Attorney, Agent, or Firm*—Kenyon & Kenyon

[57] ABSTRACT

A printing unit with a rotatable print cylinder and a rotatable blanket cylinder is provided. A tubular printing blanket is removably mounted on the blanket cylinder. The printing unit may have an imaging unit mounted therein. A printing member, which is mountable on the print cylinder, is imaged by the imaging unit inside the printing unit. The printing member has a continuous surface and may be removed axially from the print cylinder. The printing unit may be configured as a cantilever printing unit, or, alternatively, may be configured with both a gear side frame and a work side frame for supporting the print and blanket cylinders. In order to provide a variable-cutoff capability, a plurality of print cylinder saddles may be provided. Each print cylinder saddle has the same inner diameter for mounting on the print cylinders. However, in order to provide a variable cut-off, the print cylinder saddles may have a variety of outer diameters.

22 Claims, 9 Drawing Sheets

Fig. 6a
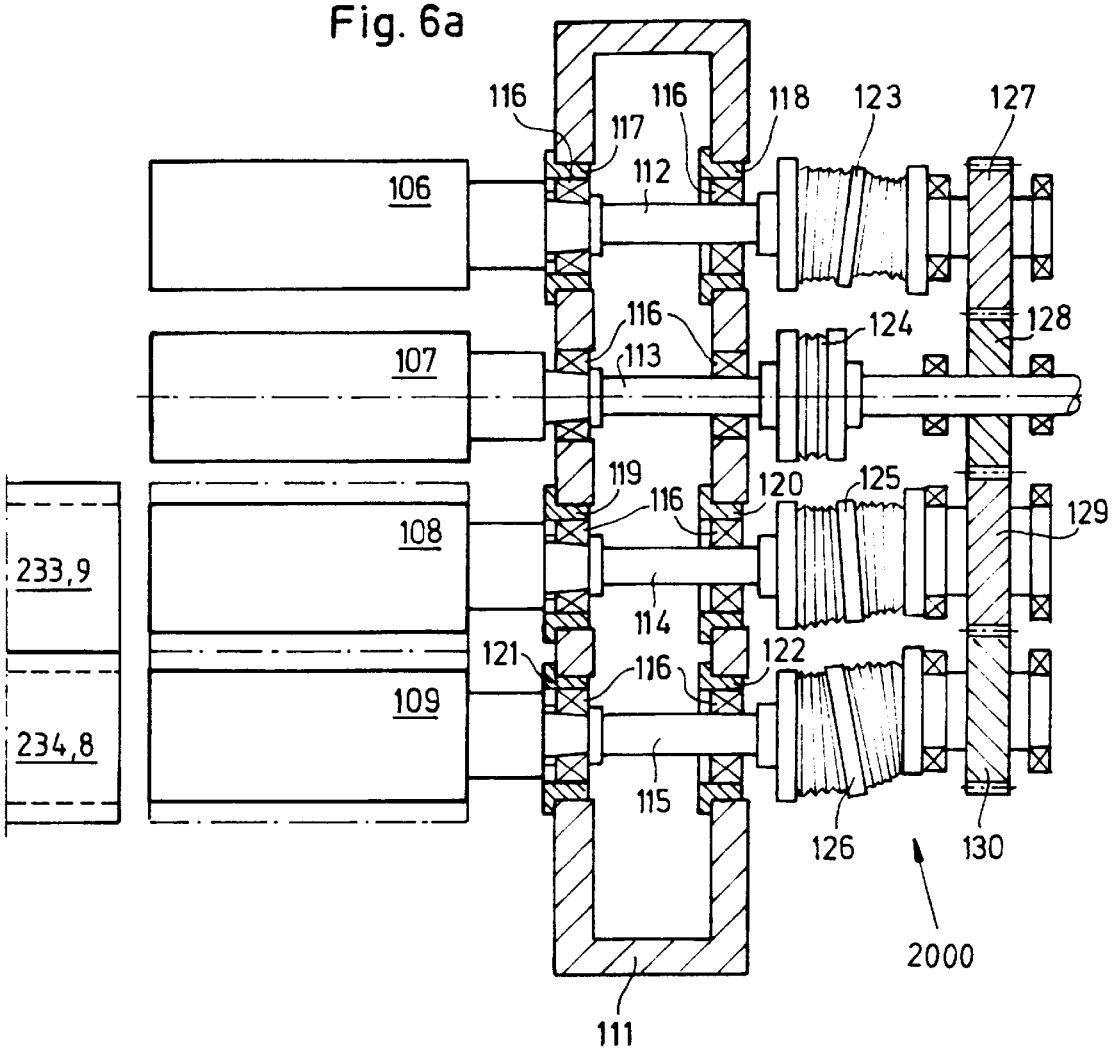
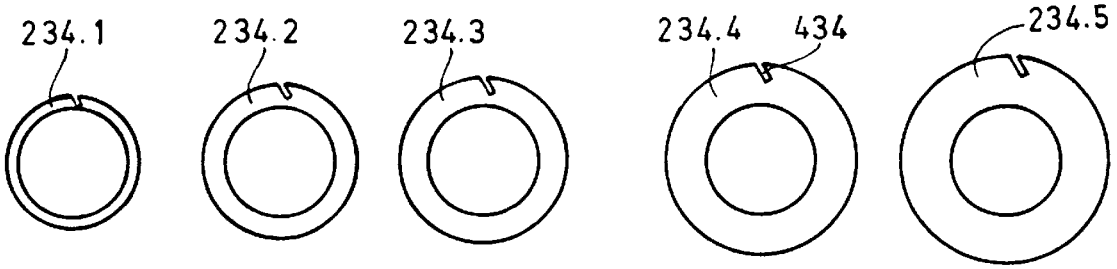
Fig. 8a

PRINTING UNIT WITH AXIALLY REMOVABLE PRINTING SLEEVES

FIELD OF THE INVENTION

The present invention relates to a printing unit having rotatable printing unit cylinders.

BACKGROUND INFORMATION

A rotary printing unit has a plurality of rotatable printing cylinders. An offset printing unit, for example, has a print cylinder and a blanket cylinder. The print cylinder and the blanket cylinder are supported at their opposite ends in the frame of the printing unit. The ends of the cylinders are supported for rotation in the frame by respective bearing assemblies. The print cylinder carries a print form having a surface on which an inked image is defined. The blanket cylinder carries a printing blanket. When the cylinders rotate in the printing unit, the print form on the print cylinder transfers the inked image to the blanket on the blanket cylinder at a nip between the print cylinder and the blanket cylinder. The blanket on the blanket cylinder subsequently transfers the inked image to the material being printed, such as a web of paper.

The print cylinder and/or the printing blanket can be formed as a tube which is mounted on the respective cylinder by sliding the tube telescopically over the cylinder. When such a tubular printing member is to be moved telescopically over a cylinder, the cylinders are first moved into respective throw-off positions in which they are spaced away from each other across the nip. An opening is provided in the adjacent side wall of the frame, so that the tubular printing member can be moved axially past the side wall of the frame through the opening. A clearance is also provided for the tubular printing member to move past the bearing which supports the end of the cylinder on the adjacent side wall of the frame.

U.S. Pat. No. 5,241,905 discloses a printing unit with a releasable bearing clamp. A bearing assembly includes a bearing housing fixed to a stub shaft on the end of a blanket cylinder. A door assembly assigned to the blanket cylinder allows for the exchange of tubular printing blankets.

Laid open European Patent Application EP 0 512 549 A1 purports to disclose a printing press, having a plate cylinder with a plate supply unit. The plate supply unit is mounted within the plate cylinder for winding spent plates off the circumference of the cylinder and unwinding unexposed plates onto the circumference of the plate cylinder. A plurality of ink supply units are arranged around the circumference of the plate cylinder. At least one cleaning section is assigned to the circumference of the plate cylinder.

U.S. Pat. No. 4,408,868 purports to disclose a digital plate system and method. Incremental areas of a charged electro photographic member are discharged to form thereon a text or an image. The imaged member is thereafter toned and output from the imaging system so that the toned image may be fused on the image member and the image member may be used as a printing plate in a lithographic printing press.

U.S. Pat. No. 4,729,310 relates to a method for perforating the surface of a gravure cylinder for a gravure press. U.S. Pat. No. 5,129,321 purports to disclose a direct to press imaging system for use in lithographic printing in which a magnetically active hydrophilic powder is applied onto the surface of a master image cylinder, the master image cylinder having a magnetizable surface layer.

SUMMARY OF THE INVENTION

In accordance with a first embodiment of the present invention, a printing unit for an offset printing press includes a rotatable print cylinder and a rotatable blanket cylinder. tubular printing blanket can be axially mounted on, and removed from, the rotatable blanket cylinder by a pneumatic locking and releasing device. A printing member is mounted on the rotatable print cylinder. The printing member has a continuous outer surface and, like the tubular printing blanket, is axially mounted on, and removed from, the rotatable print cylinder by a pneumatic locking and releasing device. The printing member is imaged by an imaging unit inside the printing unit. Preferably, the printing member is seamless so as to allow endless printing. However, if endless printing is not necessary, the printing member may include a seam. In addition, in order to reduce vibrations and increase print quality, the cylinders of the printing unit are preferably arranged substantially within an in-line stack configuration.

In accordance with a second embodiment of the present invention a cantilever printing unit for an offset printing press is provided which includes a gear-side frame which supports an upper print cylinder, an upper blanket cylinder, a lower blanket cylinder, and a lower print cylinder. A first end of the upper print cylinder is rotatably supported within the gear-side frame by a first positioning mechanism. The first positioning mechanism is operable to adjust a radial position of the upper print cylinder. The first end of the upper print cylinder is also attached to a first flexible coupling. The lower print cylinder and lower blanket cylinder are similarly supported in the gear side frame by respective second and third positioning mechanisms, and attached to respective second and third flexible couplings. A first end of the upper blanket cylinder is rotatably mounted within the gear-side frame. The first, second, and third positioning devices may be constructed as eccentrics or as brackets. A gear assembly is coupled to the upper blanket cylinder, and to the first, second, and third flexible couplings. The gear assembly drives the upper blanket cylinder, the upper print cylinder, the lower print cylinder, and the lower blanket cylinder. Since the upper print cylinder, lower blanket cylinder, and lower print cylinder are coupled to the gear assembly by flexible couplings, the gear assembly can drive the cylinders regardless of the radial position of the cylinders. As a result, even during throw-off, the upper print cylinder, lower blanket cylinder, and lower print cylinder remain fully engaged with the gear assembly. Consequently, in accordance with this embodiment, the printing unit may be constructed as a cantilever press, i.e., without a workside frame.

In accordance with a third embodiment of the present invention, the printing presses of the first and second embodiments are modified to provide a variable cut-off printing press. In prior art systems, in order to provide a variable cut-off printing press, the print cylinders, blanket cylinders, and gears were constructed as a cylinder module, and a cylinder module having a first cut-off could be replaced with another cylinder module having a second, different cut-off. In contrast, in accordance with the third embodiment of the present invention, a plurality of print cylinder saddles are provided. Each of the plurality of print cylinder saddles have a similar inner diameter for being secured to the upper or lower print cylinder. However, in order to provide variable cut-off, each of the plurality of print cylinder saddles can have a different outer diameter. The print cylinder saddles are axially mountable on, and removable from, the upper and lower print cylinders. The print cylinder saddles may be constructed with an axially extending gap for receiving a flat printing plate, or, alternatively, may be configured to receive a tubular printing plate. Moreover, the printing press according to the third embodiment of the present invention may be constructed as a cantilever printing press, or as a printing press having cylinders supported by both gear side and work side frames. In addition, the print cylinder saddle may be configured to receive a tubular printing member, and the printing unit may include an imaging unit for imaging the printing member within the printing unit.

BRIEF DESCRIPTION OF THE DRAWINGS

FIG. 6(*b*) shows an illustrative embodiment of a positioning device of FIG. 6(*a*);

FIG. 8(*b*) shows a print cylinder saddle having a gear mounted thereon according to a further embodiment of the present invention.

DETAILED DESCRIPTION OF THE INVENTION

Figure 1:
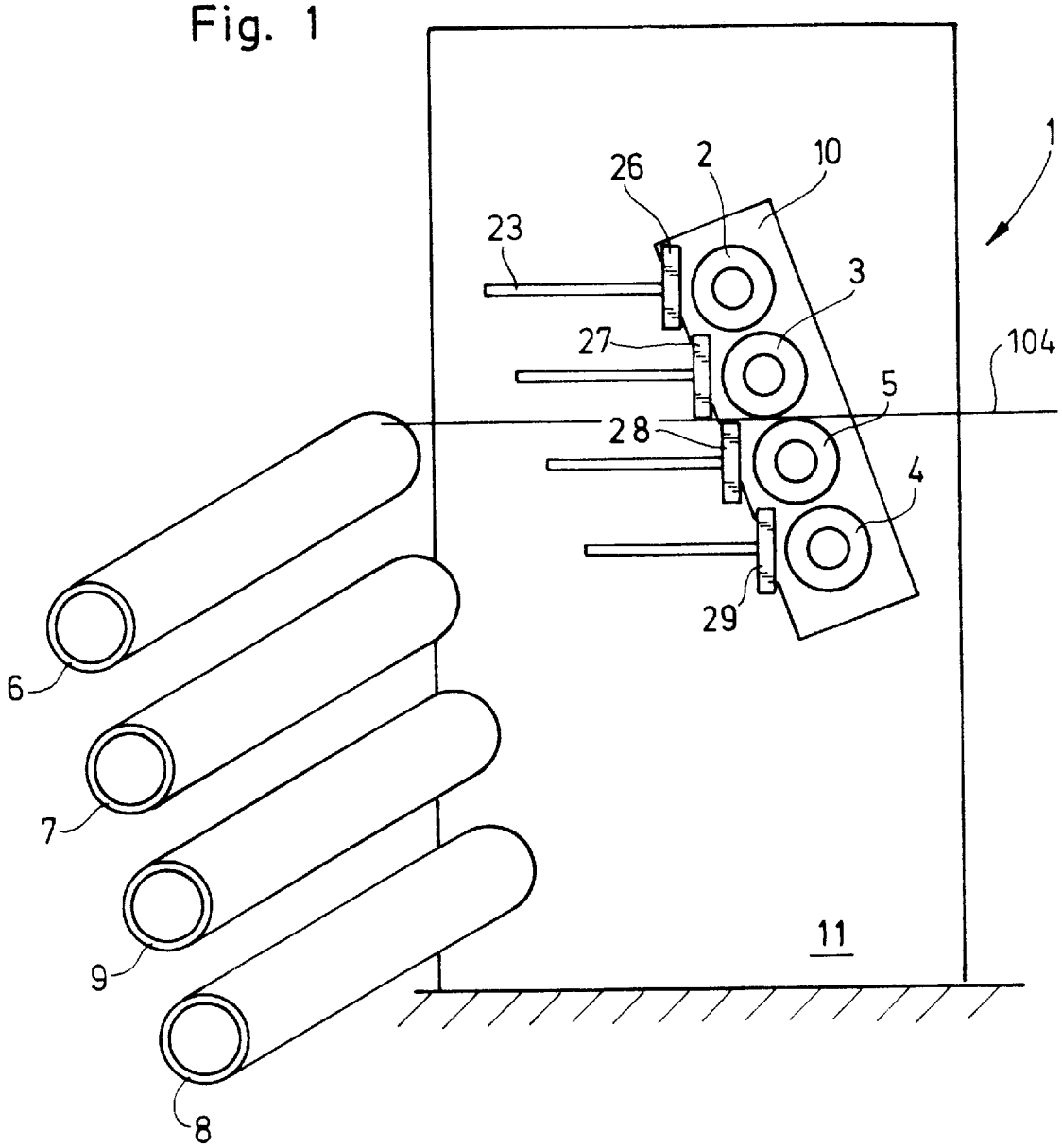
FIG. 1 shows a schematic view of a printing unit of a printing press according to a first embodiment of the present invention with tubular print forms and tubular printing blankets being removed.

FIG. 1 shows a printing unit 1 for an offset printing press according to a first embodiment of the present invention. The printing unit 1 is operable to print an image on both sides of a web 104. The printing unit 1 includes an upper printing print cylinder 2 and an upper blanket cylinder 3 above the web 104, as well as a lower print cylinder 4 and a lower blanket cylinder 5 below the web 104. The cylinders 2, 3, 4 and 5 are supported for rotation at opposite ends on a work side frame 11 and a gear side frame 11'(not shown). The work-side frame 11 has an opening 10 for allowing axial removal of tubular sleeves 6–9. Door assemblies 26, 27, 28 and 29, shown in an opened position in FIG. 1, are mounted to the work side frame and allow for the removal of the respective tubular sleeves 6, 7, 8, 9. The sleeves include a tubular print form 6 for the upper print cylinder 2, a tubular printing blanket 7 for the upper blanket cylinder 3, a tubular printing blanket 9 for the lower blanket cylinder 5, and a tubular print form 8 for the lower print cylinder 4. In FIG. 1, the door assemblies 26, 27, 28 and 29 have been swung into an opened position by respective door actuation mechanisms 23(e.g., hydraulic or pneumatic cylinders). The cylinders 2,3,4,5 of printing unit 1 may be configured substantially with-in an in-line stack arrangement to reduce vibration and allow for increased operating speeds.

Once the cylinders 2,3,4,5 are in throw-off position, the tubular sleeves 6, 7, 8 and 9 can be axially removed from the respective cylinders 2,3,4,5 through the opening 10. During throw-off, the upper print cylinder 2 is thrown-off upwards away from the upper blanket cylinder 3 which remains in its position. The lower blanket cylinder 5 as well as the lower print cylinder 4 are thrown-off downward relative to the upper blanket cylinder 3. Thus, cylinders 2, 3, 4 and 5 are spaced away from each other, allowing sufficient distance between each other's circumference for axial removal of the sleeves 6, 7, 8 and 9.

Figure 2:
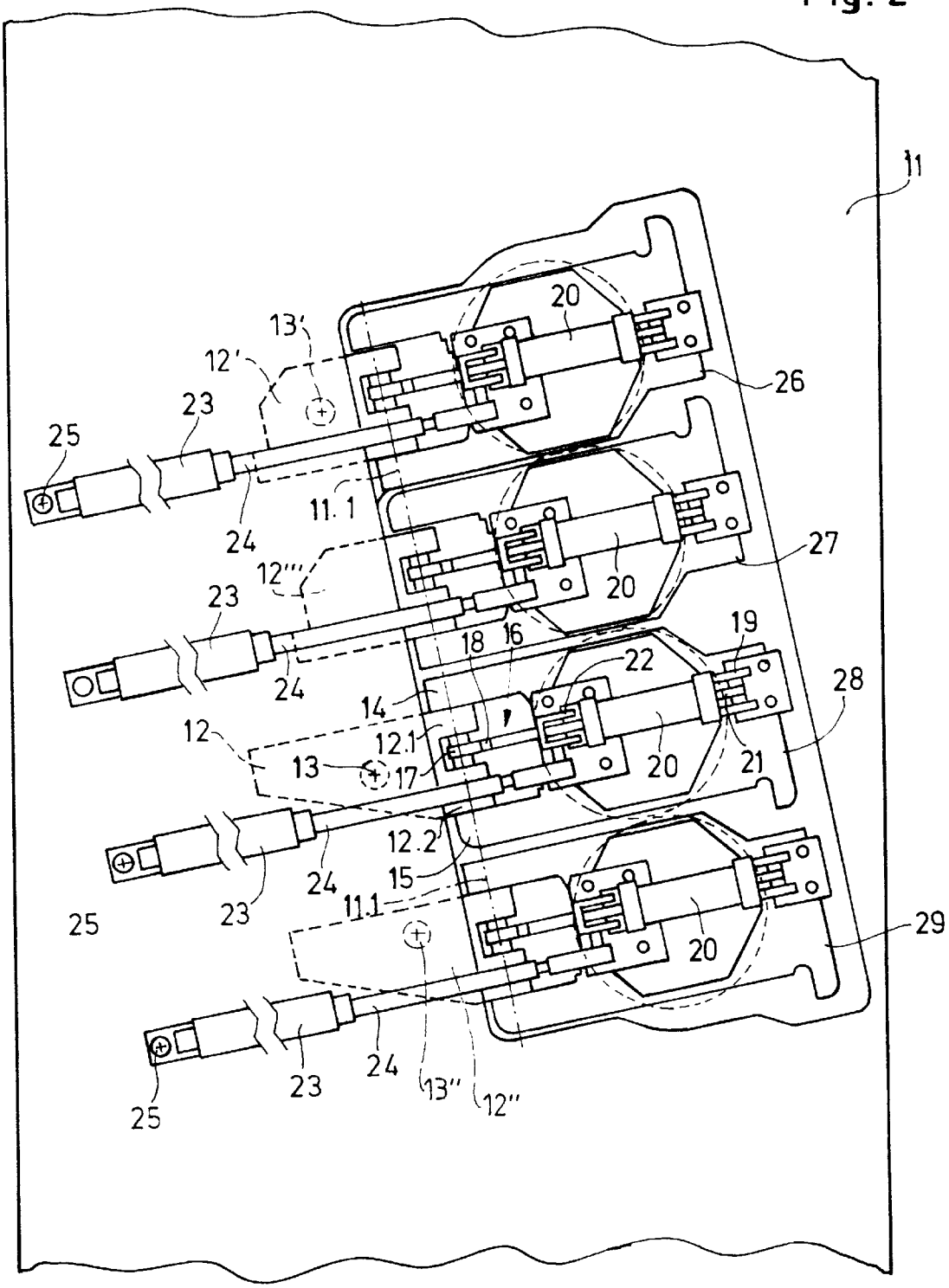
FIG. 2 shows the printing unit of FIG. I in greater detail including a door arrangement on a work-side of the printing unit.

FIG. 2 shows the door assemblies on the work-side frame 11 in greater detail. Corresponding to the in-line stack configuration of the cylinders 2, 3, 4 and 5 there are arranged four door assemblies 26, 27, 28 and 29. The door assemblies 26, 28, and 29 assigned to the upper print cylinder 2, lower blanket cylinder 5, and lower print cylinder 4 are pivotable around horizontal throw-off axes 13, 13', 13" upon a throw-off movement and will be described in more detail below. The cylinder covered by the door assembly 27, i.e. the upper blanket cylinder 3, remains in its position during throw-off.

The work-side frame 11 has inner edge surfaces extending around the ends of the printing unit cylinders and defining the opening 10. When the first door assembly 26 is opened, the tubular print form is telescopically movable onto and off of the upper print cylinder 2. The tubular print form is fastened to the cylinder by a friction fit and released from the cylinder by applying compressed air through the cylinder surface to expand the sleeve as described in more detail below. The second, third, and fourth door assemblies 27, 28, 29 assigned to the upper blanket cylinder 3 lower blanket cylinder 5, and lower print cylinder 4 similarly allow for exchange of tubular printing blanket 7, tubular printing blanket 9, and tubular print form 8.

The third door assembly 28 assigned to the lower blanket cylinder 5 includes a bracket 12. The bracket 12 is supported on the work-side frame 11 for pivotal movement around a horizontal throw-off axis 13 . The first door assembly 26 assigned to the upper print cylinder 2 includes a bracket 12'. The bracket 12' is supported on the work-side frame 11 for pivotal movement around a horizontal throw-off axis 13'. The fourth door assembly 29 assigned to the lower print cylinder 4 includes a bracket 12". The bracket 12" is supported on the work-side frame 11 for pivotal movement around a horizontal throw-off axis 13". The second door assembly 27 includes a bracket 12" which remains stationary during throw-off.

The door assemblies 26–29 will now be described with reference to door assembly 28. The bracket 12 has upper arms 12.1 and lower arms 12.2 which support upper and lower arms 14, 15, respectively, of the door assembly 28. The door 28, thus, is supported for pivotal movement around a vertically extending axis 11.1 between a closed position and an opened position. The door assembly 28 is equipped with a pair of clamps for fastening a bearing housing of a print cylinder bearing, as described in more detail in U.S. Pat. No. 5,241,905. The door assembly 28, furthermore, includes a linkage assembly 16. The linkage assembly 16 includes a first link 17, a second link 18 and a third link 19. The inner end of the first link 17 is supported between the upper and lower arms 12.1, 12.2 of the bracket 12 for pivotal movement around the vertically extending axis 11.1. The outer end of the first link 17 is pivotally connected to the second link 18 between the opposite ends of the second link 18. The second link 18 extends through the door 28 between the upper and lower arms 14, 15 of the door assembly 28. The inner end of the second link 18 is pivotably connected to a clamp on the door 28. The outer end of the second link 18 is pivotably connected to a turnbuckle. The turnbuckle (not shown) extends from the second link 18 to the third link 19 and is pivotably connected to the third link 19. The third link 19, finally, is connected with the door 28.

A first pressure cylinder 20 is pivotably connected to a second bracket 22 on the door 28. The pressure cylinder 20 has a piston rod 21 which is pivotably connected to the third link 19. When the piston rod 21 moves out of the pressure cylinder 20, the piston rod 21 moves the third link 19 in a counter-clockwise direction. By means of the above-mentioned turnbuckle, the second link 18 is pivotably moved in a counter-clockwise direction relative to the first link 17. The clamp on the door 28, which is connected to the inner end of the second link 18, is moved by the second link 18 from a clamping position to a releasing position. When the piston rod 21 is moved back into the pressure cylinder 20, the clamp on the door 28 is moved back from its releasing position to its clamping position. The linkage assembly 16, particularly the turnbuckle connected to the third link 19, is arranged in a manner that, even if the pressure in the pressure cylinder 20 fails, the clamp on the door 28 is kept in its clamping position.

The door assembly 28 includes an actuating assembly for opening and closing the door 28. The actuating assembly includes a second pressure cylinder 23 and a further piston rod 24. The second pressure cylinder 23 is supported in the side wall 11 on a pivot axis 25. The piston rod 24 is pivotably connected to the second bracket 22 on the door assembly 28. When the piston rod 24 moves into the second pressure cylinder 23, the piston rod 24 moves the door 28 pivotably about the vertically extending axis 11.1 in a clockwise direction. Thus, the door assembly 28 is moved from the closed position to the opened position. When the piston rod 24 is subsequently moved back out of the second pressure cylinder 23, it moves the door 28 back from the opened position to the closed position. A stop on the work-side frame wall 11 prevents movement of the door 28 beyond the closed position.

When printing operation is interrupted to replace one or more of the tubular sleeves 6, 7, 8 and 9 from the printing unit cylinders 2, 3, 4 and 5, the cylinders are moved into their thrown-off positions by a throw-off mechanism (not shown). The throw-off mechanism is associated with the brackets 12, 12', 12" on the work-side frame wall 11 to move the brackets 12, 12', 12" around the horizontal throw-off axes 13, 13', 13". Consequently, the door arrangements 26, 28 and 29 move around horizontal axes 13, 13', 13" during throw-off. Only the door arrangement 27 remains in its position, since the upper blanket cylinder 3, remains in its position during throw-off. The second pressure cylinder 23 and the piston rod 24, both of which are connected to the second bracket 22 on the door assembly 28, move pivotably around the horizontal axis 13 with the door 28. In accordance with a preferred embodiment of the present invention, throw-off is accomplished in accordance with the counterpoise and lift mechanism disclosed in copending application Ser. No. 08/577,996 filed Dec. 22, 1995, now U.S. Pat. No. 5,678,485, issued Oct. 21, 1997, entitled "Counterpoise and Lift Mechanism" the specification of which is hereby incorporated by reference.

After the printing unit cylinders 2, 4 and 5 have been moved into their thrown-off positions, the clamps which support the respective bearing housings, move into their releasing positions, thereby allowing the tubular sleeves on the blanket cylinders 3 and 5 and the tubular sleeves on the upper and lower print cylinders 2 and 4 to be changed. The sleeves 6, 7, 8 and 9 are removed through the openings in the work-side frame wall 11. During change of the sleeves 6, 7, 8 and 9 the printing unit cylinders are supported at their opposite ends by a suitable counterpoise mechanism as described in copending application Ser. No. 08/577,996 filed Dec. 22, 1995, now U. S. Pat. No. 5,678,485, issued Oct. 21, 1997, entitled "Counterpoise and Lift Mechanism".

Figure 3:
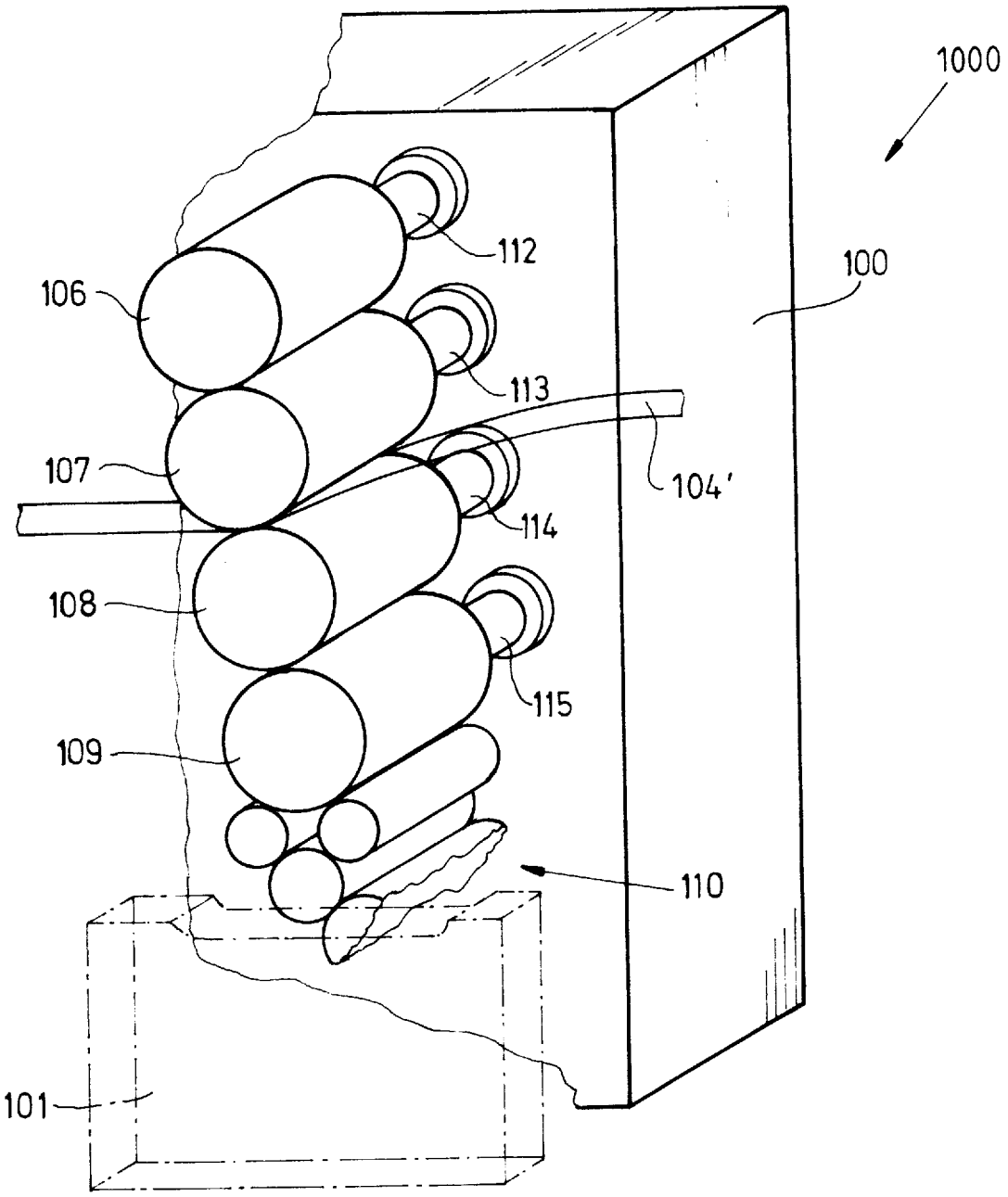
FIG. 3 shows a cantilevered printing unit according to a second embodiment of the present invention having an access space for print form and printing blanket exchange.
Figure 4:
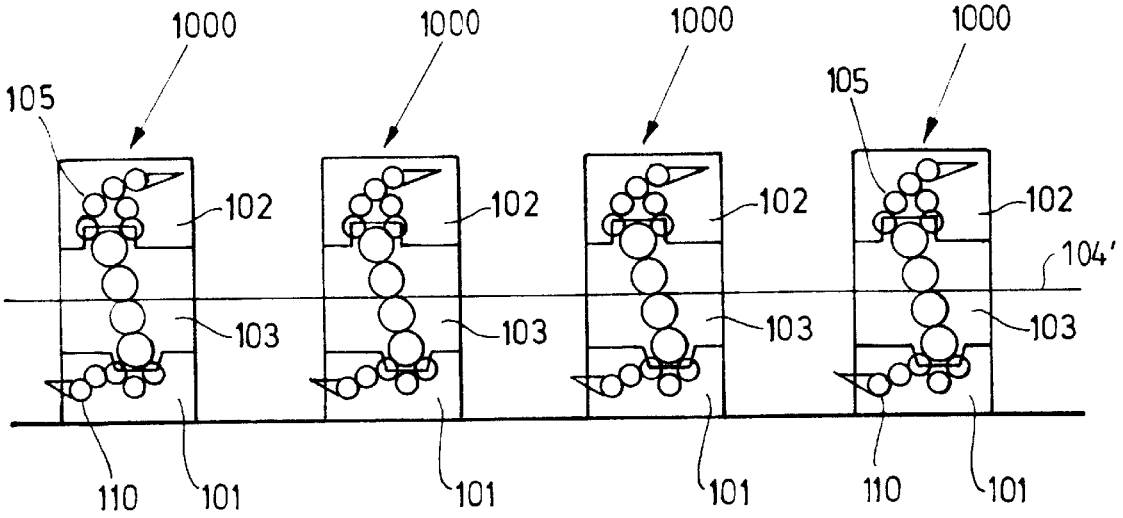
FIG. 4 shows a plurality of cantilevered printing units arranged in a row.
Figure 5:
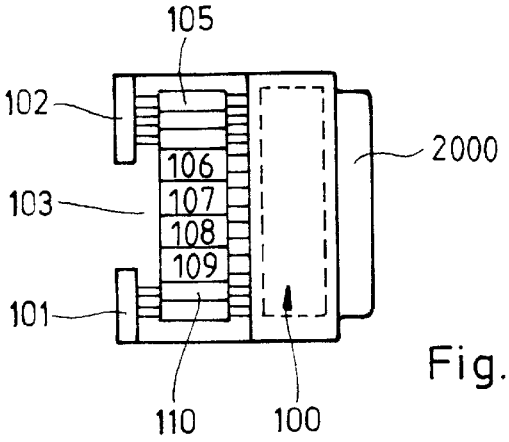
FIG. 5 is a front view of the cantilevered printing unit of FIGS. 3 & 4.

FIGS. 3–5 show a cantilevered printing unit 1000 according to a second embodiment of the present invention. The cantilevered printing unit 1000 includes a gear-side frame 100, a work-side lower inking unit frame 101 and a corresponding work-side upper inking unit frame 102. An access space 103 is defined between the inking unit frames 101 and 102. A web path 104' extends in a substantially horizontal plane between an upper cantilevered blanket cylinder 107 and a lower cantilevered blanket cylinder 108. The upper cantilevered blanket cylinder 107, which includes a stub shaft 113 supported in the gear-side frame 100, cooperates with the upper cantilevered print cylinder 106, which includes a stub shaft 112 supported in the gear-side frame 100. Similarly, the lower blanket cylinder 108, which is supported by a stub-shaft 114 in the gear-side frame 100, cooperates with a lower cantilevered print cylinder 109, which is supported by a stub-shaft 115 in the gear side frame 100. Below the lower cantilevered print cylinder 109 there is arranged the lower inking unit 110. In contrast to the printing unit 1 of FIGS. 1–2, the cylinders 106–109 of the cantilever printing unit 1000 are supported only by the gear side frame 100 because the cantilever printing unit 1000 does not include a work side frame.

FIG. 4 shows four cantilevered printing units 1000 arranged to form a 4-unit color offset press, with each printing unit 1000 printing a separate color (e.g. cyan, magenta, yellow, black). The access space 103 is defined by the upper and the lower inking unit frames 101 and 102. The access space 103 allows for axial removal of the sleeves from the surfaces of the printing unit cylinders 106, 107, 108 and 109. Behind the work-side lower and upper inking unit frames 101 and 102 there are schematically shown the inking units 105 and 110. The web path 104' extends in a substantially horizontal plane as shown.

FIG. 5 shows a front view of the cantilevered printing unit 1000. A gear train 2000 driving the unit 1000 is arranged on or within the gear-side frame 100, and the access space 103 allows for the exchange of sleeves on the print cylinders 106 and 109 as well as on the blanket cylinders 107 and 108 as shown.

Figure 6B:
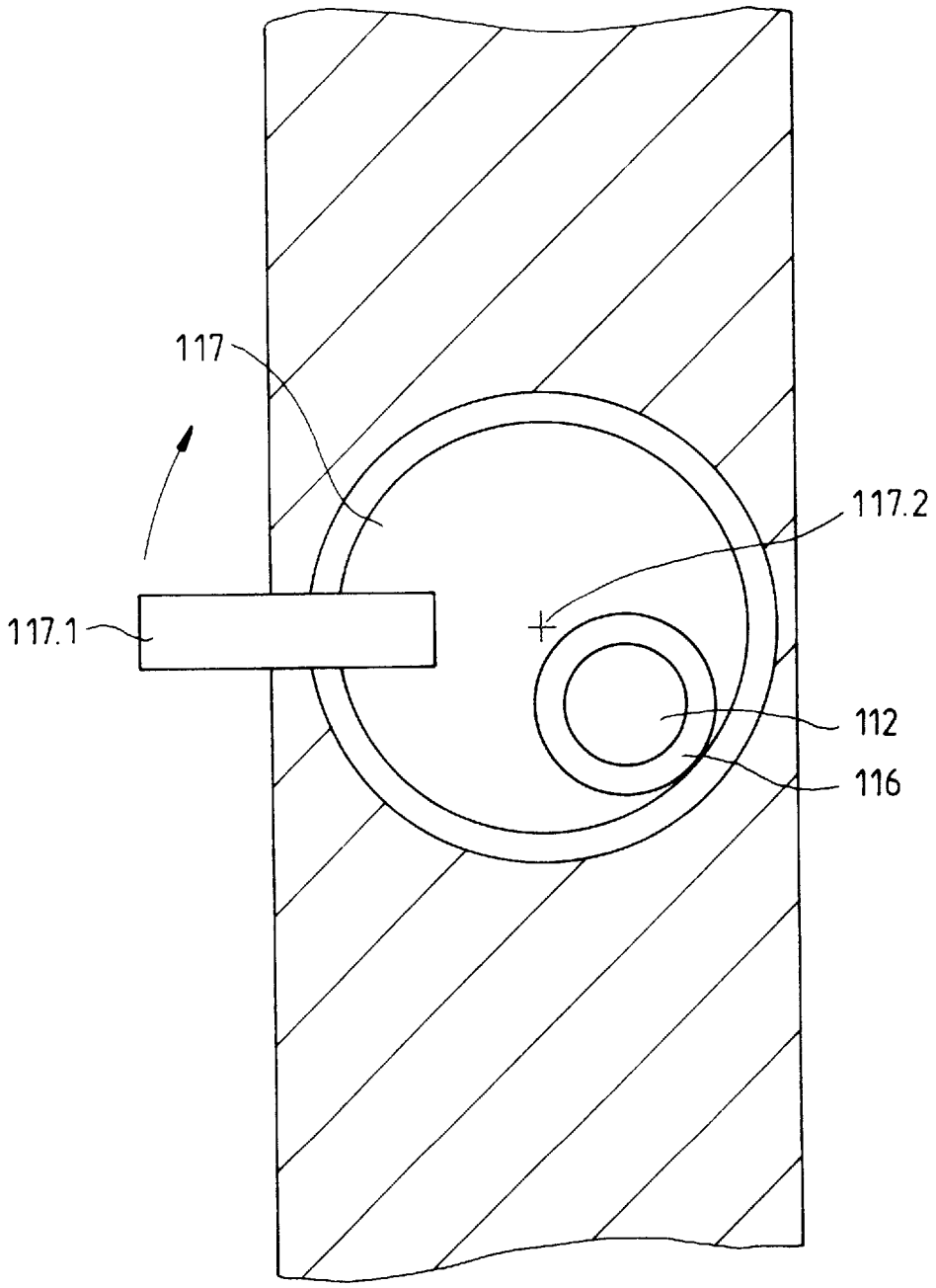
FIG. 6(*a*) is a cross-section of a gear-side frame of the cantilever printing unit of FIGS. 3–5.

FIG. 6(*a*) shows a cross-section of the gear-side frame 100. Within the gear-side frame 100 there is provided a cylinder shaft support 111 as well as the gear train 2000. The upper cantilevered print cylinder 106 has a cylinder shaft 112 supported in positioning devices 117 and 118 by means of bearings 116. The upper print cylinder shaft 112 is driven by a radially flexible yet torsionally rigid coupling 123; i.e., a torsionally rigid coupling which allows axial misalignment or axial displacement (hereinafter referred to as a flexible coupling). This flexible coupling 123 is connected to a gear 127. The gear 127 meshes with a driven gear 128. The upper cantilevered blanket cylinder 107 is provided with an axially extending cylinder shaft 113. The upper blanket cylinder shaft 113 is mounted by means of bearings 116 in the cylinder shaft support 111. The corresponding coupling 124 is torsionally rigid and is driven by drive (not shown).

The lower cantilevered blanket cylinder 108 on which a lower tubular printing blanket 9 is mounted has a cylinder shaft 1 14 which is supported by means of bearings 116 in positioning devices 119 and 120. The lower blanket cylinder shaft 114 is driven by a gear 129 connected to a flexible coupling 125. Furthermore, the lower cantilevered plate cylinder 109 has an axially extending cylinder shaft 115 with bearings 116. The bearings 116 are supported by positioning devices 121 and 122. The lower plate cylinder shaft 115 is driven by the gear 130 via a flexible coupling 126.

In order to remove the lower tubular printing blanket 9, the lower tubular print form 8, the upper tubular printing blanket 7, and the upper tubular print form 6 from the corresponding cylinders, the lower blanket cylinder 108 and the lower plate cylinder 109 are moved downward into the thrown-off position, and the upper print cylinder 106 is moved upward into throw-off position. The upper cantilevered blanket cylinder 107 remains in its position. In order to throw off the printing unit cylinders from each other, the positioning devices 117, 118; 119, 120 and 121, 122 are moved radially. The positioning devices can be eccentrics, brackets, or similar cylinder positioning devices. The movement of the upper cantilevered print cylinder 106, the lower cantilevered blanket cylinder 108 and the lower cantilevered print cylinder 109 is compensated by the flexible couplings 123, 125 and 126.

For example, referring to FIG. 6(*b*), the positioning device 117 may be configured as an eccentric housing 117 having the bearing 116 eccentrically mounted therein. The eccentric housing 117 is rotated within the frame 100 by eccentric lever 117.1, thereby moving the bearing 16 and shaft 112 in an eccentric arc about an axis 117.2.

The flexible couplings 123–125, 126 are of know n construction. For example, the flexible couplings could be formed from a flexible disc coupling, or a flexible gear coupling. Alternatively, a CV joint could be used by providing a splined connecting rod between a pair of universal joints.

Figure 7:
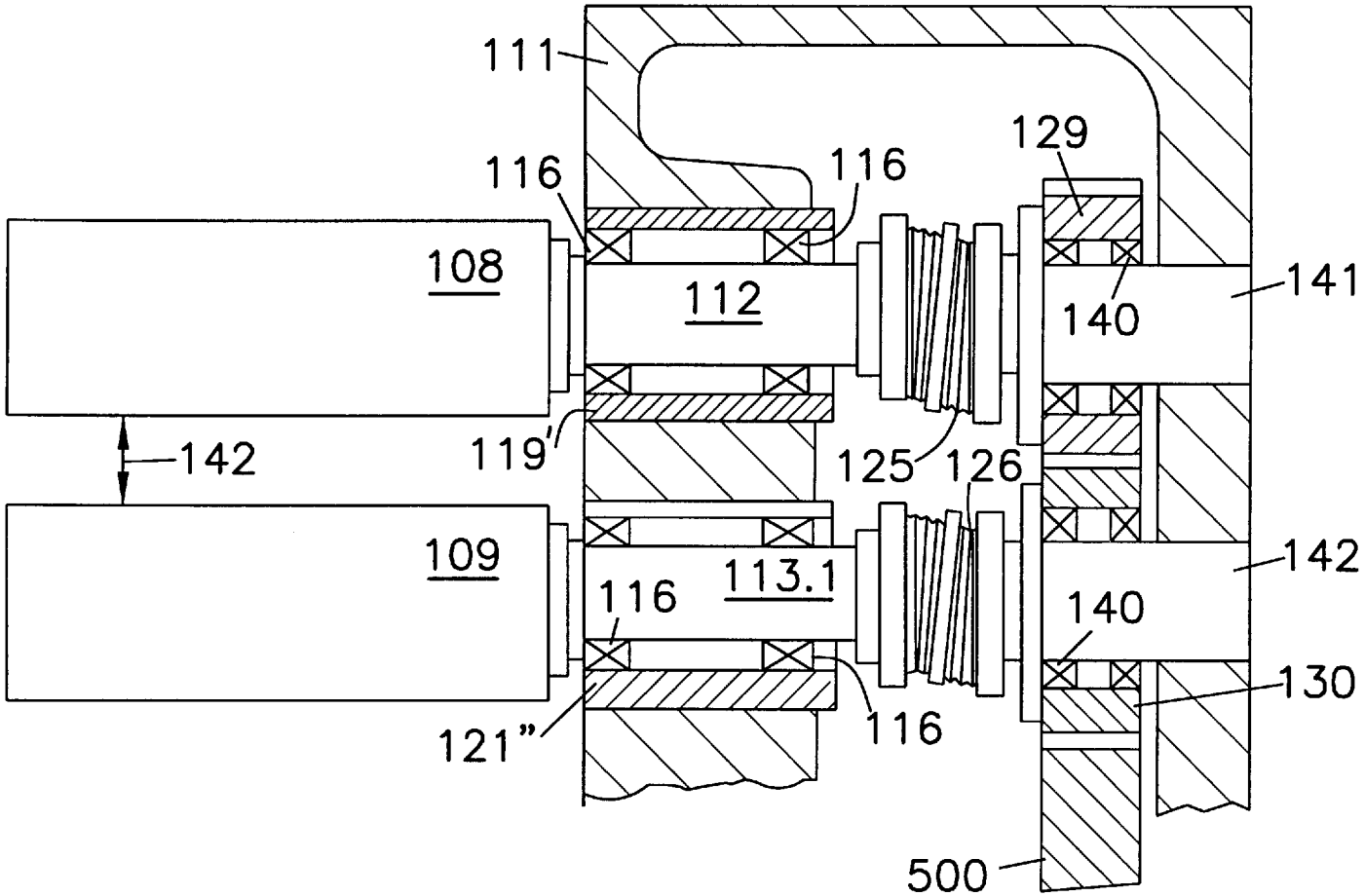
FIG. 7 is a cross-section of an alternative cylinder support for the cantilever printing unit of FIGS. 3–5 with the blanket cylinder and print cylinder in the throw-off position.

FIG. 7 shows a cross-section of an alternative cylinder shaft support of the cantilever printing unit 1000 with cylinders 108, 109 in the thrown-off position. In the embodiment of FIG. 7, positioning devices 119, 120 have been replaced with positioning device 119', and positioning devices 121, 122 have been replaced with positioning device 121'.

Positioning devices 119', 121' (e.g. eccentrics) support cylinder shafts 114 and 115 of the lower cantilevered blanket cylinder 108 and the lower cantilevered print cylinder 109 within the cylinder support shaft 111. The positioning devices 119', 121' support the shafts through bearings 116. The respective cylinder shafts 114 and 115 are connected with corresponding gears 129, 130 by flexible couplings 125, 126. The gears 129, 130, in turn, are supported on stub shafts 141, 142 by bearings 140. A drive gear 500 drives the gears 129, 130. As apparent from the surface distance between the cantilevered printing unit cylinders 108 and 109, i.e. the throw-off gap 142, both printing unit cylinders are movable by the eccentrics 139. Thus, the gap between printing unit cylinders can be enlarged allowing for a quick and easy exchange of the sleeves to be mounted on both the cantilevered upper plate cylinder 106 and the upper cantilevered blanket cylinder 107.

Moreover, by the use of flexible couplings 123, 125, 126, the meshing contact between the gears 127–130 of the gear train 2000 is not interrupted during the throw-off.

Figure 8B:
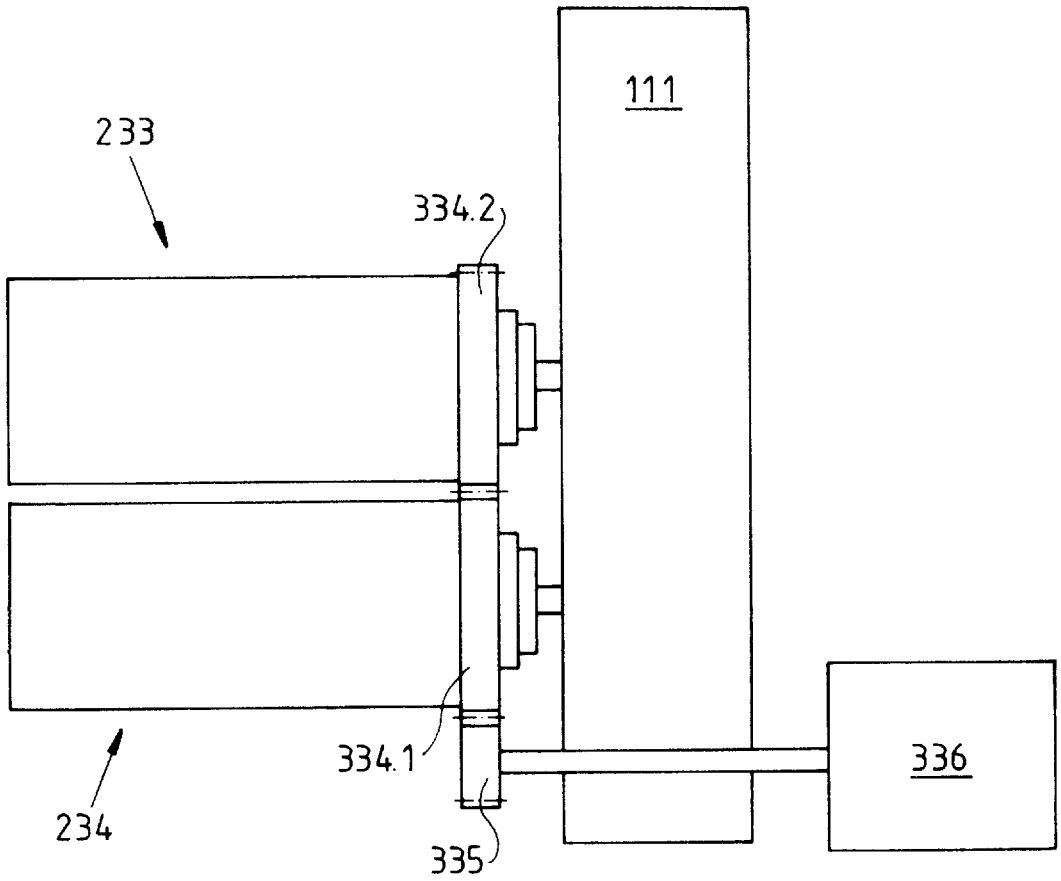
FIG. 8(*a*) shows multiple print cylinder saddles according to a third embodiment of the present invention.

FIG. 8(*a*) shows a plurality of print cylinder saddles 234.1–234.5 having varying outer circumferential surface areas in accordance with a third embodiment of the present invention. The saddles are mounted axially over the cylinders 106,109, or 2,4, to create a variable cut-off offset printing press. Blanket cylinder saddles can be provided for the blanket cylinders 107, 108 in the same manner.

The saddles 234.1-5 may be fixed to the cylinders 106, 109, or 2,4 by a friction fit. Each saddle 234 is made of an elastically expandable rigid material (e.g. nickel, aluminum, plastic, fiberglass) and has the same inner diameter. To provide a friction fit, the cylinders 106,109, 2,4 are each provided with a plurality of air passages extending to an outer surface of the cylinders. The air passages are coupled to a source of pressurized fluid (e.g. air) during installation and removal of the saddles 234.

As the saddles 234 are moved axially over the cylinders, the air pressure expands the saddles 234 to facilitate installation and removal of the saddles. Once the saddles 234 are in place over the cylinders, the air pressure is removed, the saddle 234 contracts, and a friction fit on the cylinder is established. Alternatively, radially expanding mechanical mandrels can be employed.

As an illustration, assume the upper and lower cantilevered print cylinders 106 and 109 have, for example, a standardized diameter of 5 inches. The saddles 234 would have an inner diameter of just slightly less than 5 inches in their unexpanded state. However, the outer diameter of the saddle 234.1 is 5.65", the outer diameter of the saddle 234.2 is 6.17", the outer diameter of the saddle 234.3 is 6.68", the outer diameter of the saddle 234.4 is 7.24", and the outer diameter of the saddle 234.5 is 200.5 mm (7.90"). As a result, by applying the saddle 234.1 to the print cylinders 106, 109, or 2,4, a cut-off of 17.75" is obtained. Similarly applying the saddle 234.2 provides a 19.375" cut-off; applying the saddle 234.3 provides a 21" cut-off applying the saddle 234.4 provides a 22.75" cut-off; and applying the saddle 234.5 provides a 630 mm (24.803") cut-off.

In accordance with the present invention, the print cylinder saddles can be configured to accept either tubular print forms or conventional flat printing plates.

For example, referring to FIG. 8*a*, a groove 434 can be provided for receiving each end of a conventional flat printing plate. Moreover, it is also possible to incorporate a conventional plate lockup device into the saddles 234. The flat printing plate is preferably mounted to the saddle 234 before the saddle is mounted onto the print cylinder (106, 109, 2, 4). In this manner, spare printing plates could be mounted to appropriate saddles and stored for future use. When the printing plate and/or cut-off on the press needs to be changed, the saddle 234 including the printing plate could be quickly mounted axially over the cylinder thereby reducing make-ready considerably. However, the printing plate could also be mounted to the saddle 234 while the saddle is already fixed to the cylinder. This could be accomplished by inserting one end of the printing plate into the saddle, rotating the cylinder 360 degrees, and inserting the other end of the printing plate into the saddle.

Alternatively, the cylinder saddles could have a continuous outer surface adapted to receive tubular printing forms. These tubular printing forms could be fixed to the cylinder adhesively, magnetically, or through a friction fit. Preferably, the tubular print forms are mounted to the saddles by a friction fit as follows. First, the tubular print form is slid over the saddle 234 prior to installation of the saddle 234 onto the cylinder. Since the saddle is in its unexpanded state, the tubular print form should slide easily over the saddle. Then, the saddle, with the tubular print form mounted thereon, is slid over the cylinder. As the saddle slides over the cylinder, both the saddle and the print form expand under pressure from the air passages. Once the air pressure is released, the saddle contracts partially to effect a friction fit over the cylinder. However, since the saddle has an unexpanded diameter which is smaller than the diameter of the cylinder, the saddle does not return fully to its unexpanded state, and a friction fit of the tubular print form over the saddle is accomplished.

The saddles 234, including the tubular print forms or flat printing plates, are brought into position on the cylinder by means of registering devices on the circumference of the upper and lower cantilevered plate cylinders 106 and 109. The registering devices may, for example, include a registering pin on the plate cylinder and a corresponding slot on the saddles. In such an embodiment, the saddle is brought into position on the cylinder by mating the slot on the saddle with the pin on the cylinder. Alternatively, the registering devices could comprise a line applied to the cylinder and a corresponding line applied to the saddle. The saddle could then be brought into position by aligning the line on the saddle with the line on the cylinder.

In accordance with the third embodiment of the present invention, the print cylinders (2,4,106,109) and blanket cylinders (3,5,107,108) of the printing presses (1, 1000) will occupy different positions during printing depending upon the outer diameter of the saddles 234.

Movement of the cylinders (2–5, 106–109) can be accomplished with the same mechanisms described above with respect to cylinder throw-off As such, cylinders (25, 106–109) can be mounted on brackets (as shown in FIGS. 1–2), on eccentrics (as shown in FIGS. 6–7), or in any other suitable manner. Moreover, while the upper blanket cylinders (3, 107) are shown as fixed in FIGS. 1–2, 6–7, these cylinders could also be mounted on brackets or eccentrics to allow greater flexibility.

The position of the cylinders (2–5, 106–109) can be set in the same manner that the pressure between cylinders is conventionally set in fixed cut-off presses. For example, cylinder position can be maintained by providing a pneumatic or hydraulic cylinders having pistons for applying constant force to one or more of the cylinders. Since the hydraulic/pneumatic cylinder applies a constant force, the piston(s) will extend or retract to hold the cylinders (2–5, 106–109) in rolling engagement. Alternatively, the position of the cylinders (2–5, 106–109) could be set by one or more screws. The screws, in turn, could be set automatically under the control of a motor or solenoid, or manually.

Referring to FIG. 6*a*, the gear train 2000 includes flexible couplings 123, 125, and 126, which are radially flexible. As such, when the cylinders 106–109 are moved as described above in order to vary the cut-off of the press 1000, the gears 127–130 remain engaged to each other thereby allowing the gear train 2000 to drive the cylinders 106–109 during printing. Moreover, while the gear train 2000 has been described with respect to the cantilever press 1000, it should be clear that the gear train 2000 can also be provided in the press 1 of FIG. 1 in order to provide variable cut-off in accordance with the third embodiment of the present invention.

Referring to FIG. 8(*b*), in accordance with a further embodiment of the variable cut-off printing press according to the present invention, the print cylinders (2,4, 106, 109) include saddles 234 with gears 334.1 mounted thereon. The blanket cylinders (107, 108, 3, 5) include tubular printing blankets 233. The gears 334.1 can be mounted on the saddles 234, and in accordance with the preferred embodiment, the gears 334.2 can also be mounted directly on the blankets 133. The gears 334 are driven by a drive gear 335, which, in turn, is driven by press drive 336 (shown schematically). This arrangement replaces the gear train 2000 of FIG. 6*a*. When the drive gear 335 drives the saddles 234 or the blankets 233 rather than the cylinders (2,4, 106,109), slippage of the saddles 234 and blankets relative to the cylinders becomes inconsequential, and greater tolerances can be allowed for setting the friction fit between the saddles 234 and the cylinders (2,4, 106,109). By providing the blankets 233 with gears 334.2, slippage of the blankets 233 relative to the cylinders (107, 109, 3, 5) is similarly inconsequential, and greater tolerances can also be allowed for setting the friction fit between the blankets 233 and the cylinders (3,5, 107,108). Alternatively, the gears 334 can be removably mounted on the cylinders. In accordance with this embodiment of the present invention, the diameter of the gears 334 mounted on the cylinders are selected so as to correspond to the saddles 234 being used.

Figure 9:
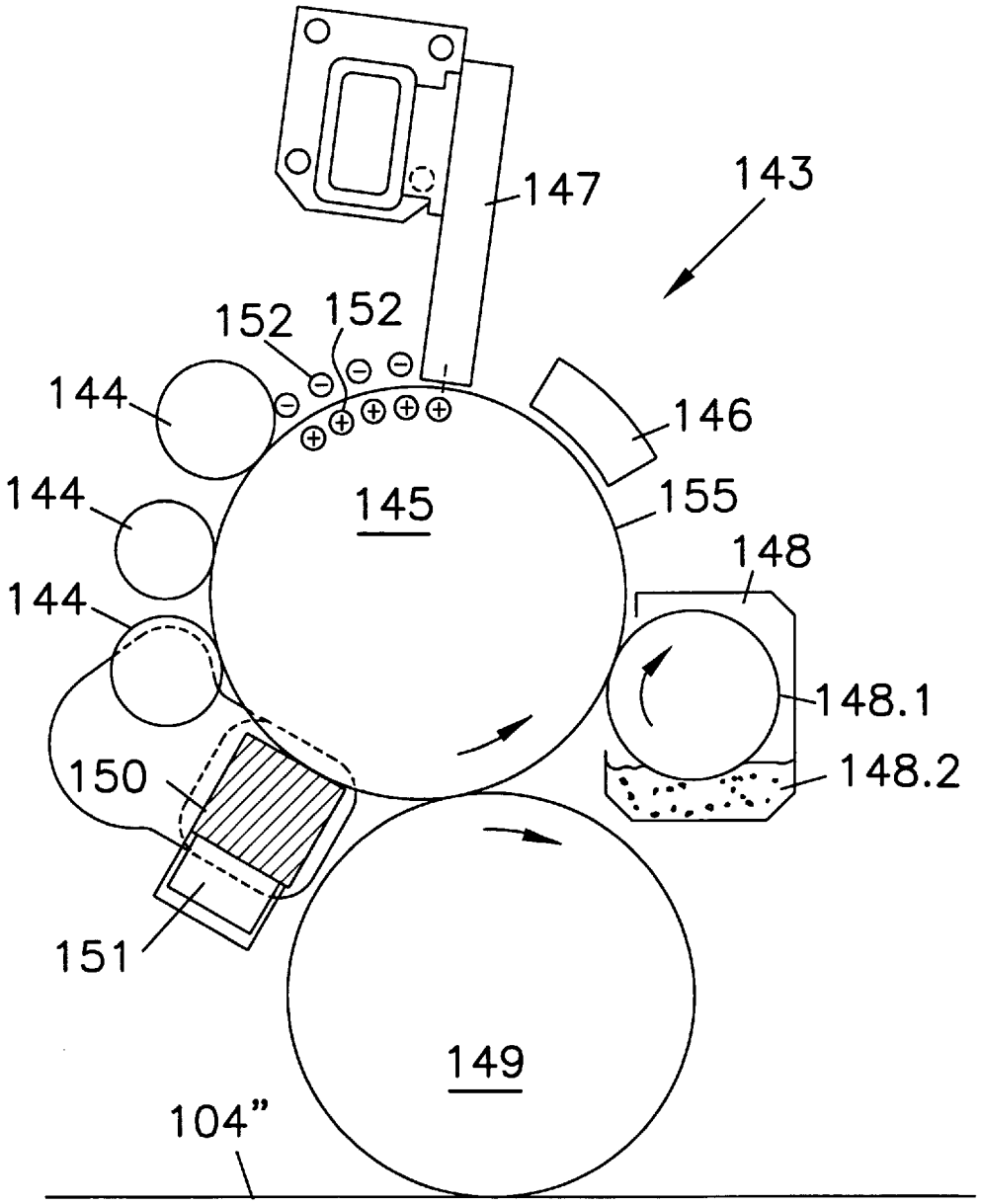
FIG. 9 shows an imaging unit for printing members.

FIG. 9 shows an imaging unit which can be mounted within the press 1 of FIGS. 1–3, or within the cantilever press 1000 of FIGS. 4–8, in accordance with a fourth embodiment of the present invention.

An imaging unit 143 is assigned to a printing member 145. A plurality of form rollers 144 transfer ink to the surface of the printing member 145, the image from the printing member 145 being transferred to the blanket 7 of the blanket cylinder (3, 149, or 107), and then onto the web 104. The printing member 145 has a continuous outer circumference. The printing member 145 can be substituted for the print cylinders 2, 4, 106, 109 of FIGS. 1–8. The image to be printed can be imaged directly off the printing member 145. Alternatively, a tubular imaging form 155 can be mounted on the circumference of the printing member 145, if both the printing member 145 and the tubular image form 155 have a dielectric surface. If a tubular imaging form 155 is utilized, it can be mounted on the printing member 145 in the same manner that the print forms 6,8 are mounted on the presses 1, 1000 as described above.

The imaging unit 143 includes a charge controller 147 which produces couples of micro dipoles 152 to create the printing and non-printing areas on the dielectric surface of the printing member 145 or tubular imaging form 155 as it rotates by the charge controller 147. The image now defined by the electrostatic charged microdipoles attracts a powder substance donor toner 148.2 from doner unit 148 via doner roll 148.1 which is separated from the surface of cylinder 145 by a small air gap. The donor toner 148.2 is of a polymer basis and is electrostatically transferred to the imaged area of the cylinder surface 145 and repelled in the non-imaged areas via the positive and negative electrostatic micro dipoles. Upon further rotation of cylinder 145, the donor toner passes a fusing unit 146 which melts and fuses the toner to the surface of the cylinder 145. In the melted and fused state the polymer imaged area is ink receptive and non-imaged areas are ink rejecting or water receptive depending on the lithographic press desired; i.e. dry or wet offset printing. The printing member 145 or tubular imaging form 155 are now ready to receive ink via form rollers 144. Imaging unit 147, donor unit 148, and fusing unit 146 now remain idle during the printing process.

As the printing member 145 rotates, an image is transferred from the printing member 145 or tubular imaging form 155 onto the surface of the blanket cylinder 149 and subsequently onto the surface of a web on web path 104".

By means of a cleaner 150, mounted on bracket 151, the fused imaged toner area can be removed from dielectric cylinder surface 145 or tubular imaging form 155. Once the fused imaged toner area is removed, new charged and non-charged areas can be formed by the charge controller, and a new donor toner application can be applied and subsequently fused as described above.

While the aforementioned embodiments of the present invention have been illustrated with respect to a double sided offset lithographic printing press (e.g., having upper and lower plate and blanket cylinders), the present invention is equally applicable to single sided offset lithographic printing presses (e.g. having a plate cylinder, blanket cylinder, and impression cylinder). Similarly, while FIGS. 6–8 show a gear assembly in which all the cylinders are driven by a single drive, the present invention is equally applicable to presses in which each cylinder is driven by a separate motor.

What is claimed is:

1. A printing unit, comprising:

a gear-side frame;

a print cylinder, a first positioning mechanism, and a first flexible coupling, the print cylinder having a first end and a second end, the first end of the print cylinder rotatably supported within the gear-side frame by the first positioning mechanism, the first positioning mechanism adjusting a radial position of the print cylinder, the first positioning mechanism including a housing having a bearing eccentrically mounted therein, the first end of the print cylinder attached to the first flexible coupling;

a blanket cylinder having a first end and a second end, the first end of the blanket cylinder rotatably mounted within the gear-side frame; and a drive assembly coupled to the blanket cylinder, and to the first flexible coupling, the drive assembly driving the blanket cylinder and the print cylinder.

2. The printing unit according to claim 1, wherein the drive assembly further comprises a first drive assembly for rotating the print cylinder and a second drive assembly for rotating the blanket cylinder.

3. The printing unit according to claim 1, wherein the respective second ends of the print cylinder and blanket cylinder are unsupported during printing.

4. The printing unit according to claim 1, further comprising a tubular printing blanket, the tubular printing blanket axially mountable on, and dismountable from, the blanket cylinder.

5. The printing unit according to claim 1, further comprising a tubular print form, the tubular print form axially mountable on, and dismountable from, the print cylinder.

6. The printing unit according to claim 5, wherein the tubular print form is seamless.

7. The printing unit according to claim 1, further comprising a plurality of tubular print cylinder saddles, each of the plurality of tubular print cylinder saddles having a similar inner diameter for being secured to the print cylinder, each of the plurality of tubular print cylinder saddles having a different outer diameter for providing a different cut-off for the printing unit.

8. The printing unit according to claim 7, wherein at least one of the plurality of print cylinder saddles includes an axially extending gap for receiving a flat printing plate.

9. The printing unit according to claim 7, wherein at least one of the plurality of print cylinder saddles has a continuous outer circumferential surface for receiving a tubular print form.

10. The printing unit according to claim 10, further comprising:

an imaging unit mounted within the printing unit;

a printing member mounted on the print cylinder, the printing member being imaged by the imaging unit inside the printing unit, the printing member having a continuous outer surface, and being axially mountable on, and removable from, the print cylinder.

11. The printing unit according to claim 1, further comprising:

a work-side frame for supporting the second ends of the print cylinder and blanket cylinder.

12. A printing unit, comprising:

a gear-side frame;

a print cylinder and a first positioning mechanism, the print cylinder having a first end and a second end, the first end of the print cylinder rotatably supported within the gear-side frame by the first positioning mechanism, the first positioning mechanism adjusting a radial position of the print cylinder;

a blanket cylinder and a second positioning mechanism, the blanket cylinder having a first end and a second end, the first end of the blanket cylinder rotatably mounted within the gear-side frame by the second positioning mechanism, the second positioning mechanism adjusting a radial position of the blanket cylinder; and a tubular print saddle having a first gear disposed thereon, the tubular print saddle mounted on the print cylinder.

13. The printing unit according to claim 12, further comprising:

a second gear removably mounted on the blanket cylinder, the first gear engaging the second gear during printing; and a drive coupled to one of the first gear and second gear for rotating the blanket cylinder and the print cylinder.

14. The printing unit according to claim 12, further comprising:

a tubular blanket cylinder saddle having a second gear disposed thereon, the tubular blanket cylinder saddle mounted on the blanket cylinder;

a second gear mounted on the blanket cylinder saddle, the first gear engaging the second gear during printing; and a drive coupled to one of the first gear and second gear for rotating the blanket cylinder and the print cylinder.

15. The printing unit according to claim 12, wherein the respective second ends of the print cylinder and blanket cylinder are unsupported during printing.

16. A printing unit, comprising:

a gear-side frame;

a print cylinder and a first positioning mechanism, the print cylinder having a first end and a second end, the first end of the print cylinder being rotatably supported within the gear-side frame by the first positioning mechanism, the first positioning mechanism adjusting a radial position of the print cylinder;

a blanket cylinder and a second positioning mechanism, the blanket cylinder having a first end and a second end, the first end of the blanket cylinder being rotatably mounted within the gear-side frame by the second positioning mechanism, the second positioning mechanism adjusting a radial position of the blanket cylinder;

a first gear removably mounted on the print cylinder; and a tubular print cylinder saddle mounted on the print cylinder.

17. The printing unit according to claim 16, further comprising:

a second gear removably mounted on the blanket cylinder, the first gear engaging the second gear during printing; and a drive coupled to one of the first gear and second gear for rotating the blanket cylinder and the print cylinder.

18. The printing unit according to claim 16, wherein the respective second ends of the print cylinder and blanket cylinder are unsupported during printing.

19. A printing unit, comprising:

a gear-side frame;

a print cylinder, a first positioning mechanism, and a first flexible coupling, the print cylinder having a first end and a second end, the first end of the print cylinder being rotatably supported within the gear-side frame by the first positioning mechanism, the first positioning mechanism adjusting a radial position of the print cylinder, the first positioning mechanism including an housing having a bearing eccentrically mounted therein, the first end of the print cylinder attached to the first flexible coupling;

a blanket cylinder, a second positioning mechanism, and a second flexible coupling, the blanket cylinder having a first end and a second end, the first end of the blanket cylinder being rotatably mounted within the gear-side frame by the second positioning mechanism, the second positioning mechanism adjusting a radial position of the blanket cylinder, the second positioning mechanism including a second housing having a second bearing eccentrically mounted therein, the first end of the blanket cylinder attached to the second flexible coupling; and a gear assembly coupled to the print cylinder and the blanket cylinder, and to the first and second flexible couplings, the gear assembly driving the blanket cylinder and the print cylinder.

20. A printing unit, comprising:

a gear-side frame;

a print cylinder, and a first positioning mechanism, the print cylinder having a first end and a second end, the first end of the print cylinder being rotatably supported within the gear-side frame by the first positioning mechanism, the first positioning mechanism adjusting a radial position of the print cylinder;

a blanket cylinder having a first end and a second end, the first end of the blanket cylinder being rotatably mounted within the gear-side frame;

a first tubular print cylinder saddle mounted on the print cylinder;

a first gear removably mounted on the print cylinder;

a second gear mounted on the blanket cylinder, the first gear engaging the second gear during printing; and a drive coupled to at least one of the first and second gears for rotating the blanket cylinder and the print cylinder.

21. The printing unit according to claim 20, further comprising a blanket cylinder saddle removably mounted on the blanket cylinder.

22. A printing unit, comprising:

a gear-side frame;

a print cylinder and a first positioning mechanism, the print cylinder having a first end and a second end, the first end of the print cylinder being rotatably supported within the gear-side frame by the first positioning mechanism, the first positioning mechanism adjusting a radial position of the print cylinder;

a blanket cylinder and a second positioning mechanism, the blanket cylinder having a first end and a second end, the first end of the blanket cylinder being rotatably mounted within the gear-side frame by the second positioning mechanism, the second positioning mechanism adjusting a radial position of the blanket cylinder;

a first gear removably mounted on the print cylinder;

a tubular print cylinder saddle mounted on the print cylinder;

a tubular blanket cylinder saddle having a second gear disposed thereon, the tubular blanket cylinder saddle mounted on the blanket cylinder, the first gear engaging the second gear during printing; and a drive coupled to one of the first gear and the second gear for rotating the blanket cylinder and the print cylinder.

* * * * *